US010347442B1

(12) United States Patent
Hinton-Hall

(10) Patent No.: US 10,347,442 B1
(45) Date of Patent: Jul. 9, 2019

(54) ILLUMINATED KEYBOARD

(71) Applicant: Pattice Hinton-Hall, Norristown, PA (US)

(72) Inventor: Pattice Hinton-Hall, Norristown, PA (US)

( * ) Notice: Subject to any disclaimer, the term of this patent is extended or adjusted under 35 U.S.C. 154(b) by 286 days.

(21) Appl. No.: 15/413,537

(22) Filed: Jan. 24, 2017

(51) Int. Cl.
*H01H 13/70* (2006.01)
*H01H 13/83* (2006.01)

(52) U.S. Cl.
CPC ..... *H01H 13/83* (2013.01); *H01H 2219/014* (2013.01); *H01H 2219/039* (2013.01)

(58) Field of Classification Search
CPC ..... H01H 13/83; H01H 9/18; H01H 9/181
See application file for complete search history.

(56) References Cited

U.S. PATENT DOCUMENTS

D461,808 S 8/2002 Achan, Jr.
7,154,059 B2 12/2006 Chou
7,214,897 B2 5/2007 Chuang
7,825,899 B2 11/2010 Chen
8,035,048 B2 10/2011 Ko
2002/0088697 A1 7/2002 Stephens
2012/0012446 A1 1/2012 Hwa
2017/0256143 A1* 9/2017 Montero ..... G06F 11/32

FOREIGN PATENT DOCUMENTS

WO 2009022124 A1 2/2009

* cited by examiner

*Primary Examiner* — Andrew J Coughlin

(57) ABSTRACT

The illuminated keyboard is a backlit keyboard. The illuminated keyboard comprises a keyboard and a switching network that generates the back lit illumination of the keyboard. The switching network divides the keyboard in to a plurality of zone displays. Each of the plurality of zone displays is used to illuminate a region of the keyboard. Each of the plurality of zone displays is independently controlled. Each of the plurality of zone displays further comprises a plurality of LEDs. Each LED contained within the plurality of LEDs is independently controlled and illuminated. Each LED selected from the plurality of LEDs is differentiated from the LEDs remaining within the plurality of LEDs by the illumination color of the selected LED. The illuminated keyboard comprises a keyboard, a switching network, and a network controller. In one potential embodiment of the disclosure, the illuminated keyboard is remote controlled.

12 Claims, 6 Drawing Sheets

ILLUMINATED KEYBOARD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of electricity including basic electric elements, more specifically, an illuminated switching network.

SUMMARY OF INVENTION

The illuminated keyboard is a backlit keyboard. The illuminated keyboard comprises a keyboard and a switching network that generates the back lit illumination of the keyboard. The switching network is positioned behind the keys of the keyboard. The switching network divides the keyboard in to a plurality of zone displays. Each of the plurality of zone displays is used to illuminate a region of the keyboard. Each of the plurality of zone displays is independently controlled. Each of the plurality of zone displays further comprises a plurality of LEDs. Each LED contained within the plurality of LEDs is independently controlled and illuminated. Each LED selected from the plurality of LEDs is differentiated from the LEDs remaining within the plurality of LEDs by the illumination color of the selected LED. The illuminated keyboard comprises a keyboard, a switching network, and a network controller. In one potential embodiment of the disclosure, the illuminated keyboard is remote controlled.

These together with additional objects, features and advantages of the illuminated keyboard will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated keyboard in detail, it is to be understood that the illuminated keyboard is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated keyboard.

It is therefore important that the claims be regarded as including such equivalent construction insofar as they do not depart from the spirit and scope of the illuminated keyboard. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
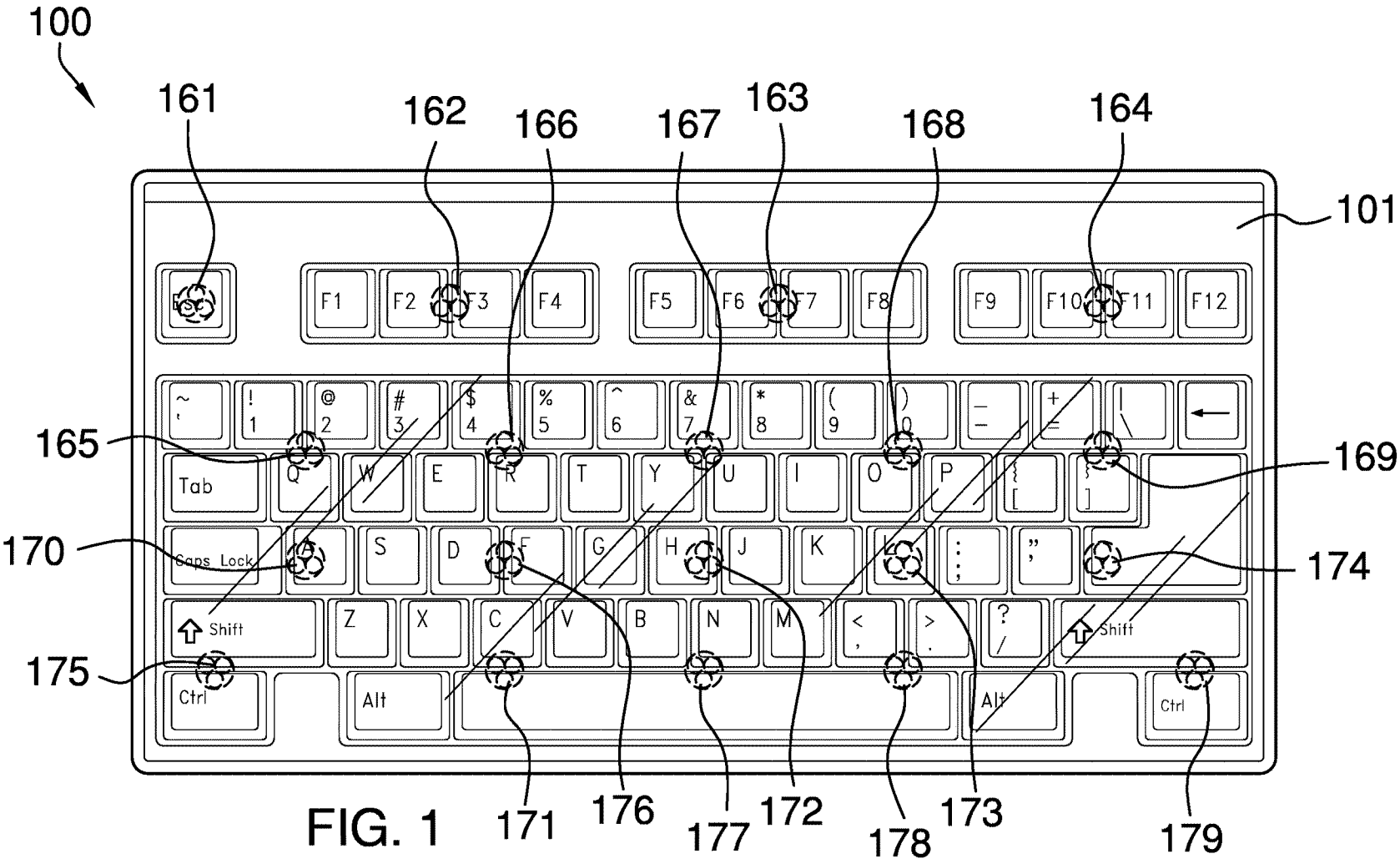
FIG. 1 is a top view of an embodiment of the disclosure.
Figure 2:
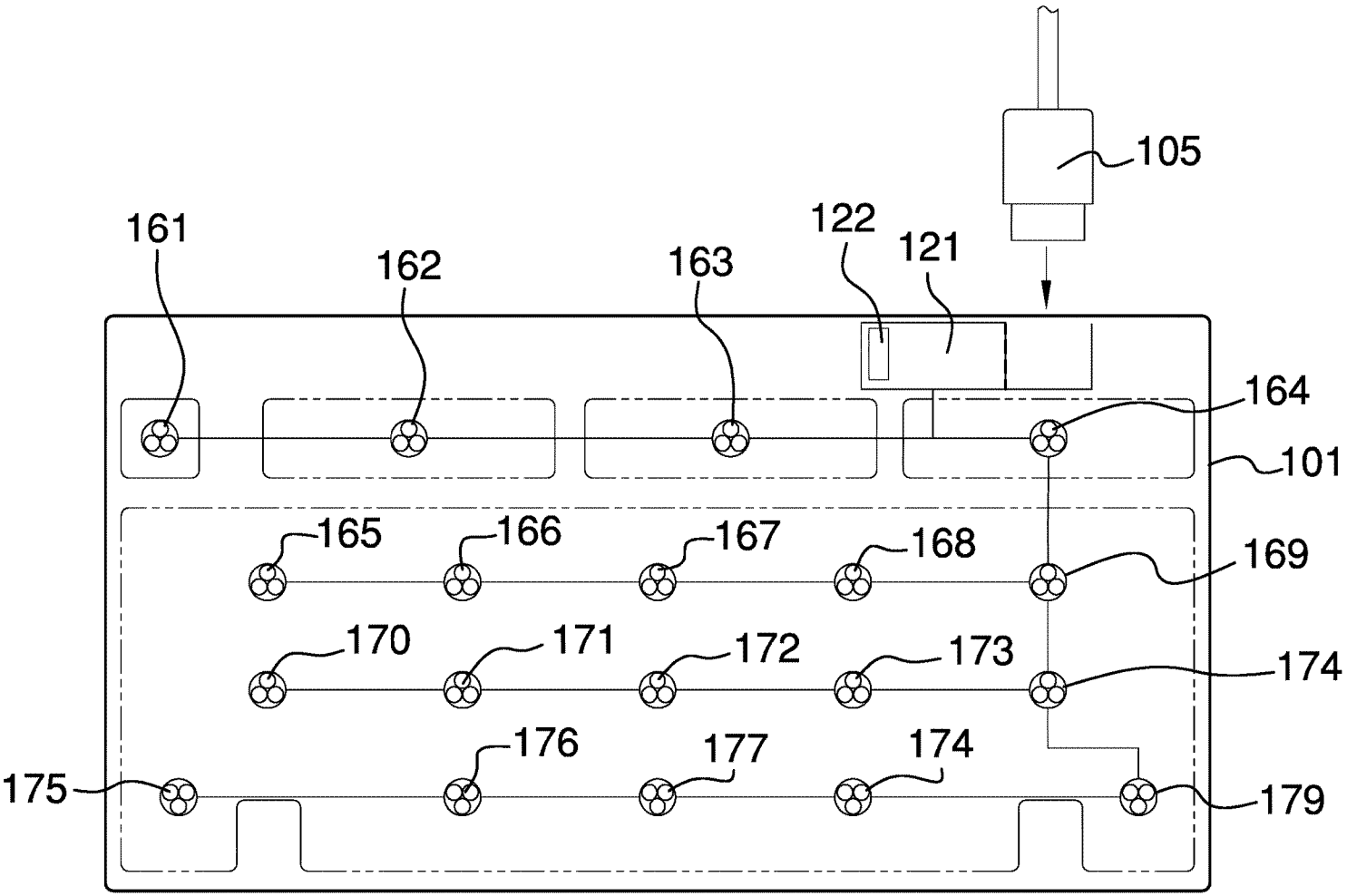
FIG. 2 is a detail view of an embodiment of the disclosure.
Figure 3:
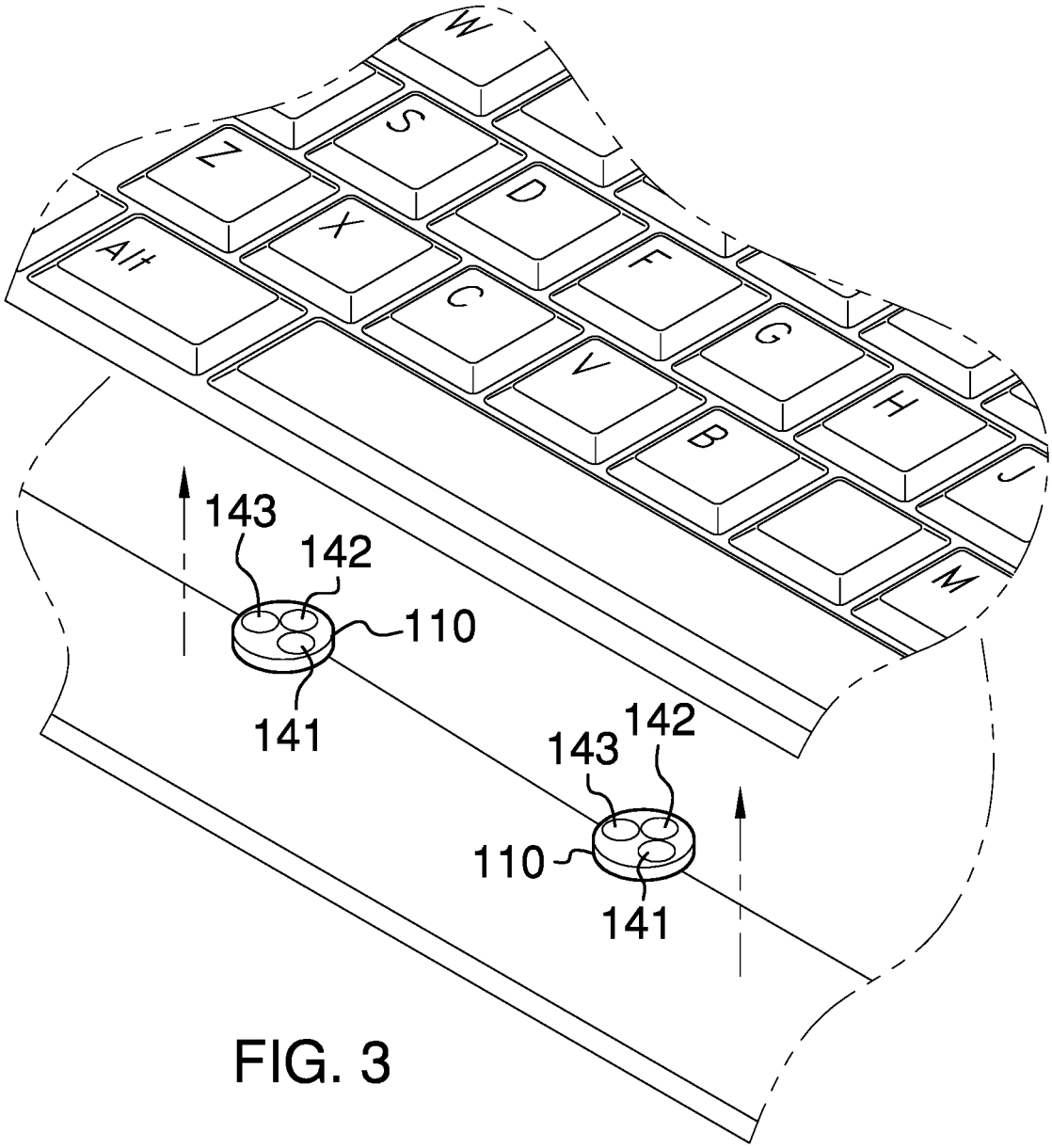
FIG. 3 is an exploded view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The illuminated keyboard 100 (hereinafter invention) comprises a keyboard 101, a switching network 102, and a network controller 103. In one potential embodiment of the disclosure, the invention 100 is remote controlled. The invention 100 is a backlit keyboard 101. The keyboard 101 is further defined with a plurality of keys. Specifically, the keyboard 101 is further defined with the following keys: "escape," "F2," "F3," "F6," "F7," "F10," "F11," "Q," "1," "2," "R," "4," "5," "Y," "U," "7," "O," "9," "0," "=," "A," "D," "F," "H," "J," "L," "Return," left side "ctrl," "C," "space," "N," "." ",":" "and right side "ctrl". The switching network 102 generates the back lit illumination of the keyboard 101. The switching network 102 is positioned behind the plurality of keys of the keyboard 101. The switching network 102 divides the keyboard 101 into a plurality of zone displays 111. Each of the plurality of zone displays 111 is used to illuminate a region of the keyboard 101. Each of the plurality of zone displays 111 is independently controlled by the network controller 103. Each of the plurality of zone displays 111 further comprises a plurality of LEDs 131. Each LED contained within the plurality of LEDs 131 is independently illuminated by the network controller 103. Each LED selected from the plurality of LEDs 131 is differentiated from the LEDs remaining within the plurality of LEDs 131 by the illumination color of the selected LED.

The keyboard 101 is a readily and commercially available keyboard. The keyboard 101 is modified by the installation of the switching network 102 and the network controller 103 such that the switching network 102 will provide backlit illumination of the keyboard 101. Methods to modify a commercially available keyboard with illumination as described within this disclosure are known and documented in the electrical and mechanical arts.

The switching network 102 comprises a plurality of zone displays 111. Each individual zone display 130 selected from the plurality of zone displays 111 is an electrical circuit that is installed in the keyboard 101 such that the individual zone display 130 illuminates a predetermined zone of the keyboard 101. The operation of any selected individual zone display 130 is controlled by the network controller 103 independently from the operation of each of the individual zone displays 130 remaining within the plurality of zone displays 111.

Each individual zone display 130 selected from the plurality of zone displays 111 is identical to the individual zone displays 130 remaining within the plurality of zone displays 111. The individual zone display 130 comprises a plurality of LEDs 131 and a plurality of limit resistors 132. There is a one to one correspondence between the plurality of LEDs 131 and the plurality of limit resistors 132. Each individual zone display 130 receives a plurality of control signals from the logic module 121. The logic module 121 is discussed in detail elsewhere in this disclosure. As shown most clearly in FIG. 7, each limit resistor selected from the plurality of limit resistors 132 is electrically connected in a series circuit with an LED selected from the plurality of LEDs 131. Each combination of LED, and the associated limit resistor, selected from the plurality of LEDs 131 is illuminated and extinguished through a control signal selected from the plurality of control signals in a manner that is independent from illumination and extinguishment of the LEDs, and the associated limit resistors, remaining within the plurality of LEDs 131. The individual zone display 130 is assembled as a single unit, generally expected to be a circuit board that can be positioned and operated by the network controller 103 independently from other individual zone displays 130.

Each LED selected from the plurality of LEDs 131 is differentiated from the LEDs remaining within the plurality of LEDs 131 by the illumination color of the LED.

In the first potential embodiment of the disclosure, the network controller 103 is a control system that illuminates extinguishes each of the plurality of zone displays 111. The network controller 103 comprises a logic module 121. The logic module 121 is a programmable device that is used to manage, regulate, and operate the network controller 103. Depending on the specific design and the selected components, the logic module 121 can be a separate component or the functions of the logic module 121 can be incorporated into another component within a computer system supported by the keyboard 101. In the first potential embodiment of the disclosure, the logic module 121 is a microcontroller. The logic module 121 interfaces with the plurality of zone displays 111 in a manner that illuminates and extinguishes the illumination of the keyboard 101.

Figure 5:
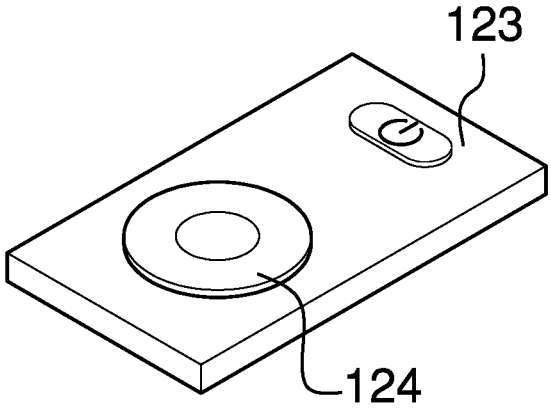
FIG. 5 is a detail view of an embodiment of the disclosure.
Figure 6:
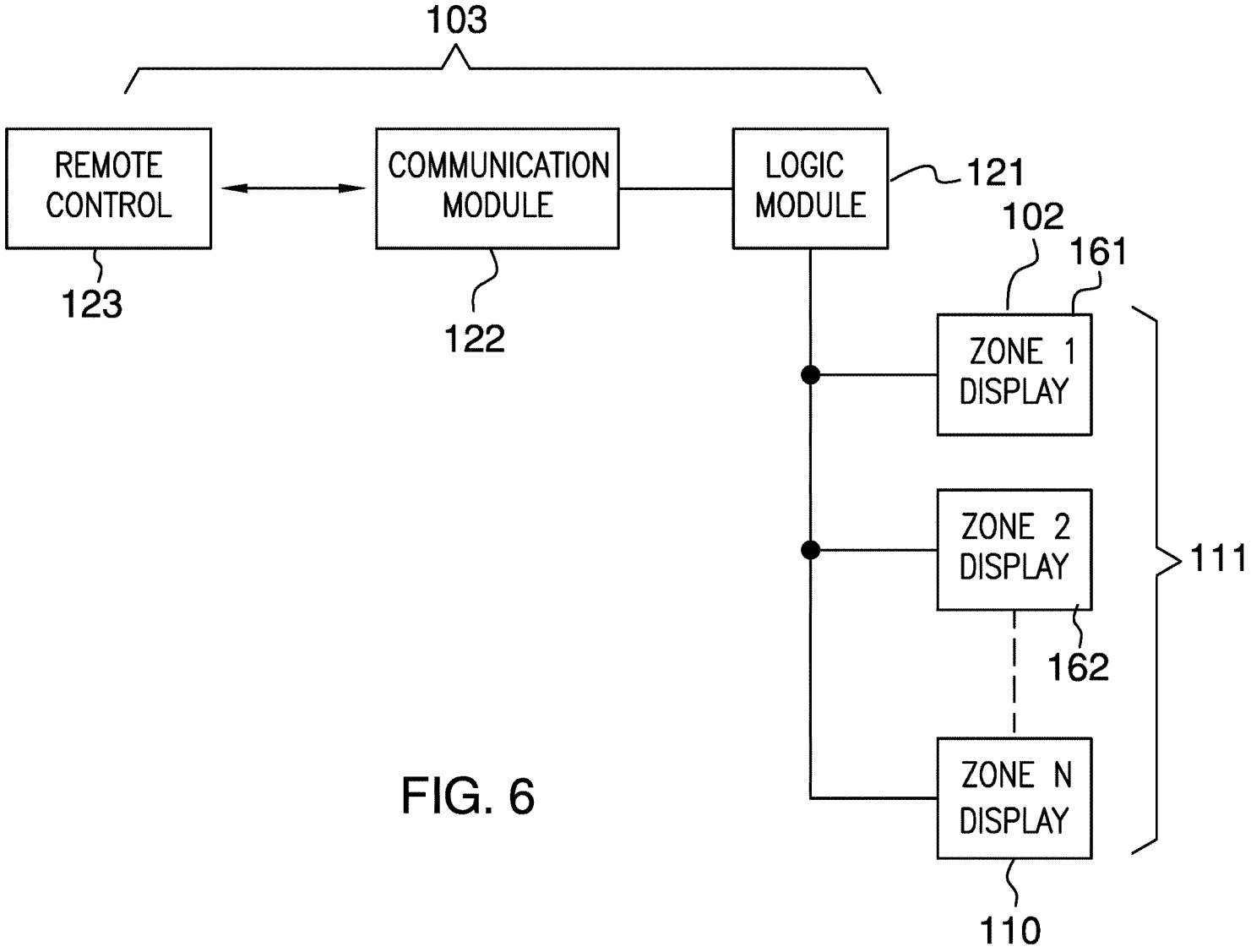
FIG. 6 is a block diagram of an embodiment of the disclosure.

A second potential embodiment of the disclosure is identical to the first potential embodiment of the disclosure with the addition that the logic module 121 further comprises a communication module 122 and a remote control device 123. The remote control device 123 is a commercially available device that is used to control the operation of the plurality of zone displays 111. The remote control device 123 is linked wirelessly to the readily and commercially available communication module 122. As shown most clearly in FIG. 6, the communication module 122 is linked to the remote control device 123 and the logic module 121 such that the communication module 122 receives operation instruction from the remote control 123 and transmits the operating instruction to the logic module 121 for implementation. The logic module 121 then implements these instructions as described in the prior paragraph. As shown in FIG. 5, the illumination and the extinguishment of the illumination of the keyboard 101 is managed through a remote control 123 device that further comprises a control wheel 124.

In the fourth potential embodiment of the disclosure, the plurality of zone displays 111 comprises a first zone display 161, a second zone display 162, a third zone display 163, a fourth zone display 164, a fifth zone display 165, a sixth zone display 166, a seventh zone display 167, an eighth zone display 168, a ninth zone display 169, a tenth zone display 170, an eleventh zone display 171, a twelfth zone display 172, a thirteenth zone display 173, a fourteenth zone display 174, a fifteenth zone display 175, a sixteenth zone display 176, a seventeenth zone display 177, an eighteenth zone display 178, and a nineteenth zone display 179.

The first zone display 161 backlights the zone of the keyboard 101 proximal to the escape key of the keyboard 101. The second zone display 162 backlights the zone of the keyboard 101 proximal to the F2 and F3 keys of the keyboard 101. The third zone display 163 backlights the zone of the keyboard 101 proximal to the F6 and F7 keys of the keyboard 101. The fourth zone display 164 backlights the zone of the keyboard 101 proximal to the F10 and F11 keys of the keyboard 101. The fifth zone display 165 backlights the zone of the keyboard 101 proximal to the Q, 1 and 2 keys of the keyboard 101. The sixth zone display 166 backlights the zone of the keyboard 101 proximal to the R, 4, and 5 keys of the keyboard 101. The seventh zone display 167 backlights the zone of the keyboard 101 proximal to the Y, U, and 7 keys of the keyboard 101. The eighth zone display 168 backlights the zone of the keyboard 101 proximal to the O, 9, and 0 keys of the keyboard 101. The ninth zone display 169 backlights the zone of the keyboard 101 proximal to the = key of the keyboard 101. The tenth zone display 170 backlights the zone of the keyboard 101 proximal to the A key of the keyboard 101. The eleventh zone display 171 backlights the zone of the keyboard 101 proximal to the D and F keys of the keyboard 101. The twelfth zone display 172 backlights the zone of the keyboard 101 proximal to the H and J keys of the keyboard 101. The thirteenth zone display 173 backlights the zone of the keyboard 101 proximal to the L key of the keyboard 101. The fourteenth zone display 174 backlights the zone of the keyboard 101 proximal to the Return key of the keyboard 101. The fifteenth zone display 175 backlights the zone of the keyboard 101 proximal to the left side ctrl key of the keyboard 101. The sixteenth zone display 176 backlights the zone of the keyboard 101 proximal to the C and space keys of the keyboard 101. The seventeenth zone display 177 backlights the zone of the keyboard 101 proximal to the N and space keys of the keyboard 101. The eighteenth zone display 178 backlights the zone of the keyboard 101 proximal to the period, the comma, and the space keys of the keyboard 101. The nineteenth zone display 179 backlights the zone of the keyboard 101 proximal to the right side ctrl key of the keyboard 101.

Figure 4:
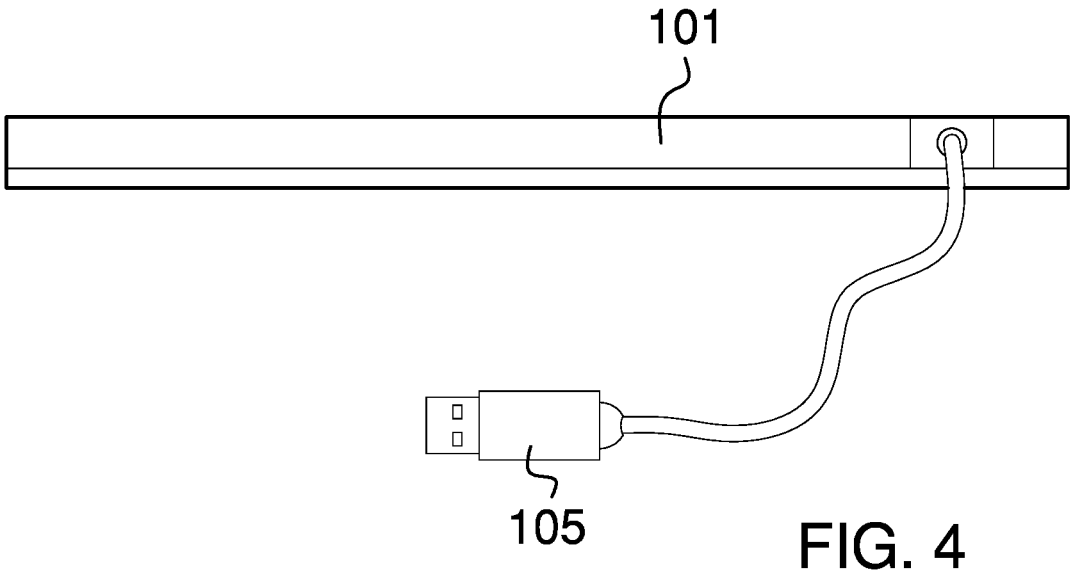
FIG. 4 is a back view of an embodiment of the disclosure.

As shown most clearly in FIG. 4, the keyboard 101 is connected to an electronic device using a USB port 105. The keyboard 101 is then used as a normal keyboard 101.

Figure 7:
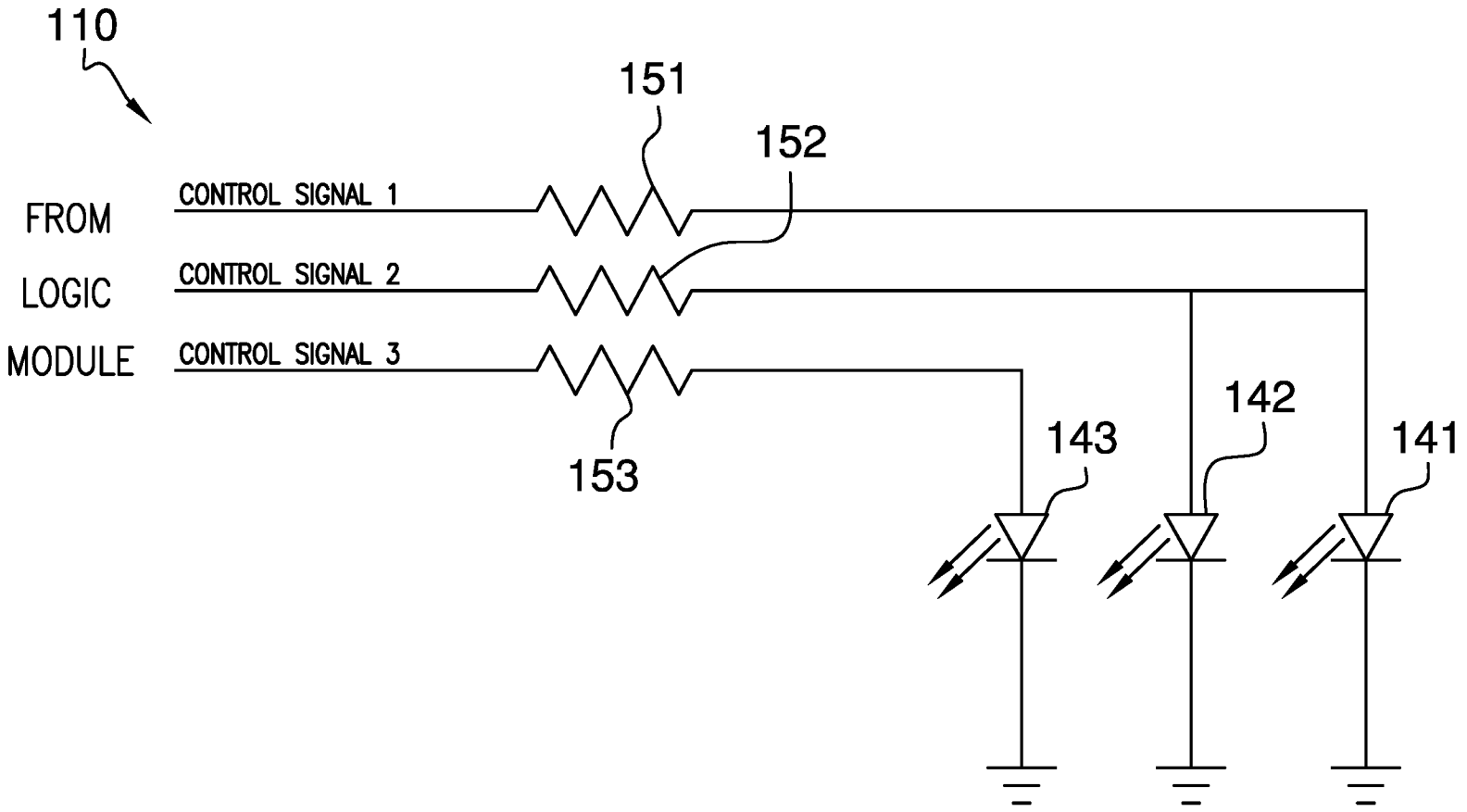
FIG. 7 is a schematic view of an embodiment of the disclosure.

In a fifth potential embodiment of the disclosure, as shown most clearly in FIG. 7, the plurality of LEDs 131 comprises a first LED 141, a second LED 142, and a third LED 143. The plurality of limit resistors 132 comprises a first limit resistor 151, a second limit resistor 152, and a third limit resistor 153. The first LED 141 corresponds to the first limit resistor 151. The second LED 142 corresponds to the second limit resistor 152. The third LED 143 corresponds to the third limit resistor 153.

The following definitions were used in this disclosure:

Control System: As used in this disclosure, a control system is a first device or system that manages and regulates the behavior or operation of a second device or system.

Correspond: As used in this disclosure, the term correspond means that a first object is in some manner linked to a second object in a one to one relationship.

Diode: As used in this disclosure, a diode is a two terminal semiconductor device that allows current flow in only one direction. The two terminals are called the anode and the cathode. Electric current is allowed to pass from the anode to the cathode.

LED: As used in this disclosure, an LED is an acronym for a light emitting diode. A light emitting diode is a diode that is also a light source.

Light: As used in this disclosure, a light is an electrical device that generates visible light to illuminate objects so they can be seen.

Logic Module: As used in this disclosure, a logic module is an electrical device that is programmable and that accepts digital and analog inputs, processes the digital and analog inputs according to previously stored instruction and provides the results of these instructions as digital or analog outputs.

Microcontroller: As used in this disclosure, a microcontroller is a small computer, often on a single integrated circuit, containing a processor core, memory, and programmable input/output peripherals.

One to One: When used in this disclosure, a one to one relationship means that a first element selected from first set is in some manner connected to only one element of a second set. A one to one correspondence means that the one to one relationship exists both from the first set the second set and from the second set to the first set. A one to one fashion means that the one to one relationship exists in only one direction.

Remote Control: As used in this disclosure, remote control means the establishment of the control of a device remotely generally through the transmission of instructions or coded signals.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An illuminated network comprising:

a keyboard, a switching network, and a network controller;

wherein the illuminated network is a backlit keyboard;

wherein the keyboard is further defined with a plurality of keys;

wherein the plurality of keys further comprises the following keys: "escape," "F2," "F3," "F6," "F7," "F10," "F11," "Q," "1," "2," "R," "4," "5," "Y," "U," "7," "O," "9," "0," "=," "A," "D," "F," "H," "J," "L," "return," left side "ctrl," "C," "space," "N," "." ",":" "and right side "ctrl";

wherein the switching network generates the back lit illumination of the keyboard;

wherein the switching network is positioned behind the plurality of keys of the keyboard;

wherein the network controller controls the switching network;

wherein the switching network comprises a plurality of zone displays;

wherein the switching network divides the keyboard into zones organized around the plurality of zone displays;

wherein each of the plurality of zone displays is used to illuminate a region of the keyboard;

wherein each of the plurality of zone displays is independently controlled by the network controller;

wherein each of the plurality of zone displays further comprises a plurality of LEDs;

wherein each LED contained within the plurality of LEDs is independently illuminated by the network controller;

wherein each LED selected from the plurality of LEDs is differentiated from the LEDs remaining within the plurality of LEDs by the illumination color of the selected LED;

wherein the keyboard is modified by the installation of the switching network and the network controller such that the switching network will provide the backlit illumination of the keyboard;

wherein each individual zone display selected from the plurality of zone displays is an electrical circuit that is installed in the keyboard such that the individual zone display illuminates a predetermined zone of the keyboard;

wherein the operation of any selected individual zone display is controlled by the network controller independently from the operation of each of the individual zone displays remaining within the plurality of zone displays;

wherein each individual zone display selected from the plurality of zone displays is identical to each of the individual zone displays remaining within the plurality of zone displays;

wherein the individual zone display comprises a plurality of LEDs and a plurality of limit resistors;

wherein there is a one to one correspondence between the plurality of LEDs and the plurality of limit resistors;

wherein each individual zone display receives a plurality of control signals from a logic module.

2. The illuminated network according to claim 1 wherein each limit resistor selected from the plurality of limit resistors is electrically connected in a series circuit with an LED selected from the plurality of LEDs.

3. The illuminated network according to claim 2 wherein each combination of LED, and the associated limit resistor, selected from the plurality of LEDs is illuminated and extinguished through a control signal selected from the plurality of control signals in a manner that is independent from illumination and extinguishment of the LEDs, and the associated limit resistors, remaining within the plurality of LEDs.

4. The illuminated network according to claim 3 wherein the individual zone display is assembled as a single unit.

5. The illuminated network according to claim 4 wherein each LED selected from the plurality of LEDs is differentiated from the LEDs remaining within the plurality of LEDs by the illumination color of the LED.

6. The illuminated network according to claim 5 wherein the network controller comprises the logic module;

wherein the logic module is a programmable device;

wherein the logic module electrically connects with the plurality of zone displays.

7. The illuminated network according to claim 6 wherein the network controller is remote controlled.

8. The illuminated network according to claim 6 wherein the logic module further comprises a communication module and a remote control device;

wherein the remote control device controls the operation of the plurality of zone displays;

wherein the remote control device is linked wirelessly to the communication module;

wherein the communication module is linked to the remote control device and the logic module such that the communication module receives operation instruction from the remote control and transmits the operating instruction to the logic module for implementation.

9. The illuminated network according to claim 8 wherein in the fourth potential embodiment of the disclosure, the plurality of zone displays comprises a first zone display, a second zone display, a third zone display, a fourth zone display, a fifth zone display, a sixth zone display, a seventh zone display, an eighth zone display, a ninth zone display, a tenth zone display, an eleventh zone display, a twelfth zone display, a thirteenth zone display, a fourteenth zone display, a fifteenth zone display, a sixteenth zone display, a seventeenth zone display, an eighteenth zone display, and a nineteenth zone display;

wherein the first zone display backlights the zone of the keyboard proximal to the escape key of the keyboard;

wherein the second zone display backlights the zone of the keyboard proximal to the F2 and F3 keys of the keyboard;

wherein the third zone display backlights the zone of the keyboard proximal to the F6 and F7 keys of the keyboard;

wherein the fourth zone display backlights the zone of the keyboard proximal to the fF10 and F11 keys of the keyboard;

wherein the fifth zone display backlights the zone of the keyboard proximal to the Q, 1, and 2 keys of the keyboard;

wherein the sixth zone display backlights the zone of the keyboard proximal to the R, 4, and 5 keys of the keyboard;

wherein the seventh zone display backlights the zone of the keyboard proximal to the Y, U, and 7 keys of the keyboard;

wherein the eighth zone display backlights the zone of the keyboard proximal to the O, 9, and 0 keys of the keyboard;

wherein the ninth zone display backlights the zone of the keyboard proximal to the = key of the keyboard;

wherein the tenth zone display backlights the zone of the keyboard proximal to the A key of the keyboard;

wherein the eleventh zone display backlights the zone of the keyboard proximal to the D and F keys of the keyboard;

wherein the twelfth zone display backlights the zone of the keyboard proximal to the H and J keys of the keyboard;

wherein the thirteenth zone display backlights the zone of the keyboard proximal to the L key of the keyboard;

wherein the fourteenth zone display backlights the zone of the keyboard proximal to the return key of the keyboard;

wherein the fifteenth zone display backlights the zone of the keyboard proximal to the left side ctrl key of the keyboard;

wherein the sixteenth zone display backlights the zone of the keyboard proximal to the C and space keys of the keyboard;

wherein the seventeenth zone display backlights the zone of the keyboard proximal to the N and space keys of the keyboard;

wherein the eighteenth zone display backlights the zone of the keyboard proximal to the period, the comma, and the space keys of the keyboard;

wherein the nineteenth zone display backlights the zone of the keyboard proximal to the right side ctrl key of the keyboard.

10. The illuminated network according to claim 9 wherein the plurality of LEDs comprises a first LED, a second LED, and a third LED;

wherein the plurality of limit resistors comprises a first limit resistor, a second limit resistor, and a third limit resistor;

wherein the first LED corresponds to the first limit resistor;

wherein the second LED corresponds to the second limit resistor;

wherein the third LED corresponds to the third limit resistor.

11. The illuminated network according to claim 10 wherein the logic module is a microcontroller.

12. The illuminated network according to claim 11 wherein the keyboard is connected to an electronic device using a USB port.

* * * * *